United States Patent [19]

Vàzquez

[11] Patent Number: 4,985,876

[45] Date of Patent: Jan. 15, 1991

[54] GLOBAL CLOCK APPARATUS

[76] Inventor: Rafael Vàzquez, Box 307 Fishkill Correctional Facility, Beacon, N.Y. 12508

[21] Appl. No.: 527,848

[22] Filed: May 24, 1990

[51] Int. Cl.[5] ..... G04B 19/22

[52] U.S. Cl. ..... 368/23

[58] Field of Search ..... 368/21–25

[56] References Cited

U.S. PATENT DOCUMENTS 1,720,902 7/1928 Isaacson ..... 368/23

FOREIGN PATENT DOCUMENTS

WO8601916 3/1986 PCT Int'l Appl. ..... 368/23
441854 1/1936 United Kingdom ..... 368/24
2044965 10/1980 United Kingdom ..... 368/23

*Primary Examiner*—Vit W. Miska
*Attorney, Agent, or Firm*—Leon Gilden

[57] ABSTRACT

An apparatus wherein a spherical globe member includes a first and second equatorial band member, wherein the upper band member is rotated at a rate of one revolution per twenty-four hours, and wherein the lower band member is rotated at one revolution per sixty minutes, wherein upper and lower pivotally mounted indicator members are mounted to align themselves relative to one another at a predetermined orientation relative to the globe to provide a timing at any predetermined position about the globe surface relative to a predetermined geographical location or time band. The apparatus further includes an optionally positioned translucent darkened shade to indicate a darkened portion of the globe in association with evening hours versus daylight hours.

6 Claims, 5 Drawing Sheets

PRIOR ART

GLOBAL CLOCK APPARATUS

BACKGROUND OF THE INVENTION

1. Field of the Invention

The field of invention relates to clock structures, and more particularly pertains to a new improved global clock apparatus wherein the same permits indication of various time about as associated globe structure.

2. Description of the Prior Art

Clocks of various types and orientations have been provided in the prior art. Clocks are frequently a source of education as well as a source of time indicating machinery. To this extend, the instant invention provides an organization to permit an individual to indicate various times at various geographic locations about a globe simulating the earth, and further provide for apparatus to indicate a darkened portion of the globe in association with evening hours relative to daylight hours. Examples of the prior art include U.S. Design patent No. 242,434; U.S. Design patent No. 127,848; U.S. Design patent No. 281,983; U.S. Design patent No. 112,610; and U.S. Design patent No. 251,414 as examples of global time pieces, each of which provide an organization failing to provide the adaptability and educational, as well as entertaining, structure as set forth by the instant invention.

As such, it may be appreciated that there continues to be a need for a new and improved global clock apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of clock apparatus now present in the prior art, the present invention provides a global clock apparatus wherein the same provides global indication of various times relative to a predetermined geographical location. As such, the general purpose of the present invention, which will be descirbed subsequently in greater detail, is to provide a new and improved global clock apparatus which has all the advantages of the prior art clock apparatus and none of the disadvantages.

To attain this, the present invention provides an apparatus wherein a spherical globe member includes a first and second equatorial band member, wherein the upper band member is rotated at a rate of one revolution per twenty-four hours, and wherein the lower band member is rotated at one revolution per sixty minutes, wherein upper and lower pivotally mounted indicator members are mounted to align themselves relative to one another at a predetermined orientation relative to the glove to provide a timing at any predetermined position about the globe surface relative to a predetermined geographical location or time band. The apparatus further includes an optionally positioned translucent darkened shade to indicate a darkened portion of the globe in association with evening hours versus daylight hours.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional featuures of the invention that will be described hereinafter and which will form the subject matter of the claims appended hereto. Those skilled in the art will appreciate that the conception, upon which this disclosue is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enabel the U.S. Patent and Trademark Office and the public generally, and especially the scientists, engineers and practitioners in the art of who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved global clock apparatus which has all the advantage of the prior art clock apparatus and none of the disadvantages.

It is another object of the present invention to provide a new and improved global clock apparatus which may be easily and efficiently manufactured and marketed.

It is a further object of the present invention to provide a new and improved global clock apparatus which is of a durable and reliable construction.

An even further object of the present inveniton is to provide a new and improved global clock apparatus which is susceptible of a low cost of manufacture with regard to both materials and labor, and which accordingly is then susceptible of low prices of sale to the consuming public, thereby making such global clock apparatus economically available to the buying public.

Still yet another object of the present inveniton is to provide a new and improved global clock apparatus which provides in the apparatuses and methods of the prior art some of the advantages thereof, while simultaneously overcoming some of the disadvantages normally associated therewith.

Still another object of the present inveniton is to provide a new and improved global clock apparatus wherein the same provides equatorial timing bands associated with the global clock and variously positionable indicator arrows to associate the equatorial time bands with a predetermined location about the global in association with a geographical location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
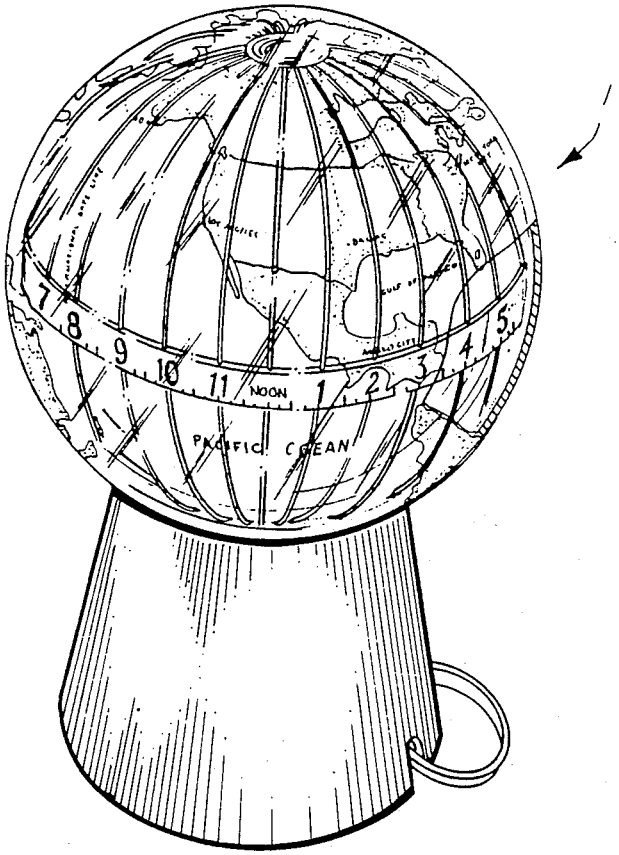
FIG. 1 is an isometric illustration of a prior art global clock structure.

With reference now to the drawings, and in particular to FIGS. 1 to 8 thereof, a new and improved global clock apparatus embodying the principles and concepts of the present invention and generally designated by the reference numeral 10 will be described.

Figure 2:
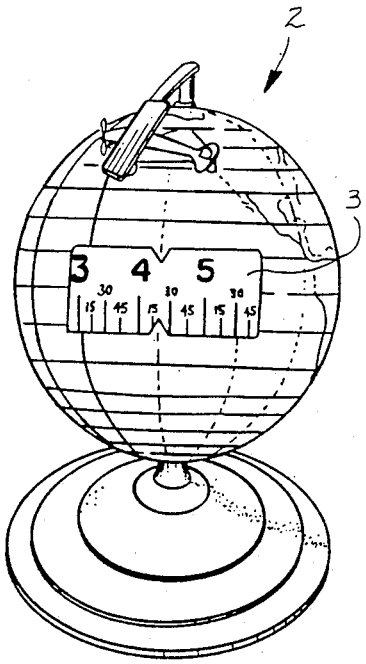
PRIOR ART FIG. 2
FIG. 2 is an isometric illustration of a further prior art global clock structure.
Figure 3:
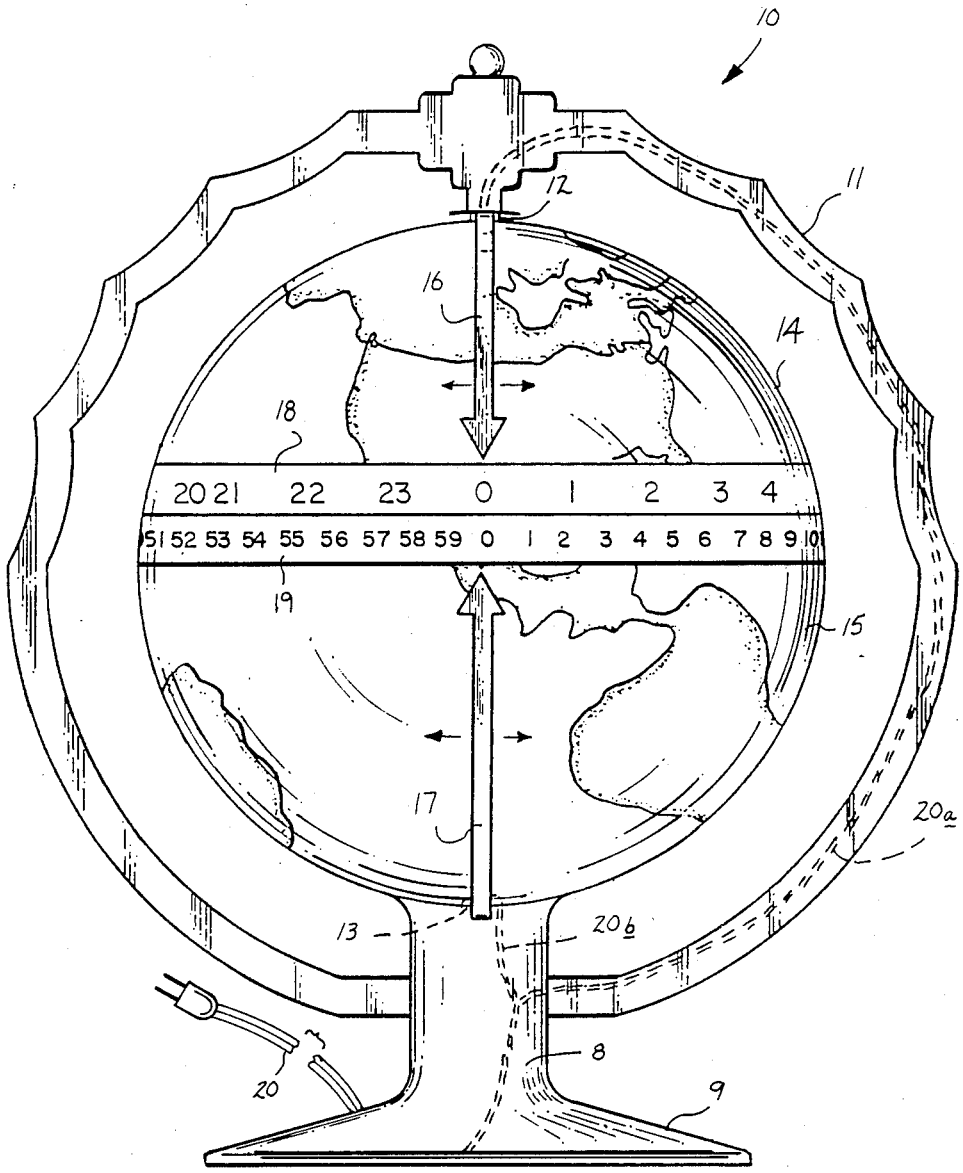
FIG. 3 is an orthographic view, taken in elevation, of the instant invention.
Figure 4:
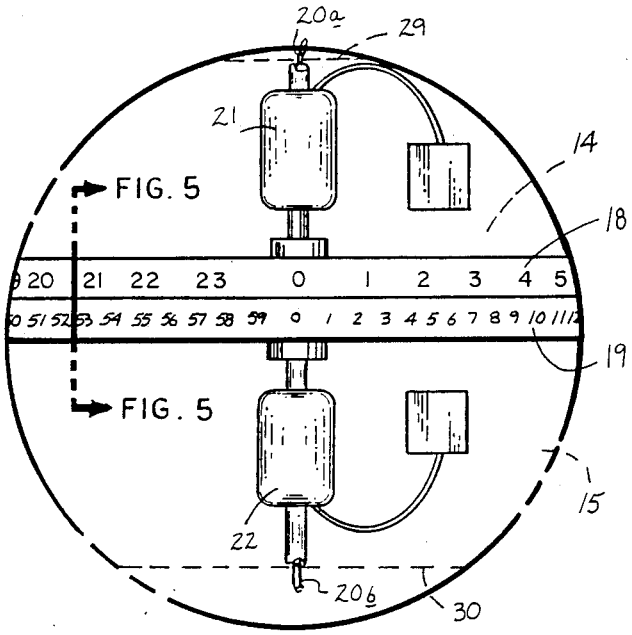
FIG. 4 is an orthographic diagrammatical illustration of the drive motors in association with the equatorial time bands of the instant invention.

FIG. 1 and FIG. 2 are illustrative of a respective first and second global clock structure 1 and 2 utilizing a single medial time band, such as the time band 3 in the structure 2 for indication of a timing event.

More specifically, the global clock apparatus 10 of the instant invention essentially comprises a surrounding, generally circular, frame 11 vertically arranged, including a pedestal base 9 coaxially aligned with a lower support 8. The circular frame 11 includes a top pivot axis 12 and a bottom pivot axis 13 coaxially aligned relative to one another, wherein the top pivot axis 12 mounts a top hemisphere 14 and the bottom pivot axis 13 mounts a bottom hemisphere 15. The top pivotal indicator arrow 16 is mounted about the top pivot axis 12 that is pivotally mounted thereto to permit repositioning of the top pivotal indicator arrow 16, wherein similarly a bottom pivotal indicator arrow 17 is pivotally mounted to the bottom pivot axis 13 to indicate a predetermined time sequence relative to the top and bottom annular equatorial time bands 18 and 19 respectively. The top and bottom time bands 18 and 19 rotate relative to one another, wherein the top time band 18 rotates at a rate of one revolution per twenty-four hours, while the bottom time band 19 rotates at one revolution per sixty minute. Accordingly, the top time band is divided into twenty-four equal hourly divisions, while the bottom time band 19 is divided into sixty equally spaced minute divisions.

An electrical power cord 20 directs power through a top power cord portion 20*a* and to a bottom power cord portion 20*b*. The top power cord portion 20*a* directs power to a top electrical motor 21, wherein similarly the bottom power cord portion 20*b* directs power to a bottom electrical motor 22. The top and bottom electrical motors 21 and 22 respectively are each mounted to a respective upper and lower mounting plate 29 and 30 respectively utilizing a respective upper and lower mounting flange 28 and 37, per the illustration in FIG. 8. It is understood that the top and bottom hemispheres 14 and 15 are fixedly mounted relative to the circular frame 11, while the top and bottom indicator arrows 16 and 17 are mounted for pivotment relative to the top and bottom hemispheres. The top electrical motor 21 is associated with a first timer 23 to provide the rotation of the top electrical motor 21 at one revolution per twenty-four hours, while the bottom electrical motor 22 utilizes a second timer 24 to provide one revolution per sixty minutes (see FIG. 4 for example).

Figure 5:
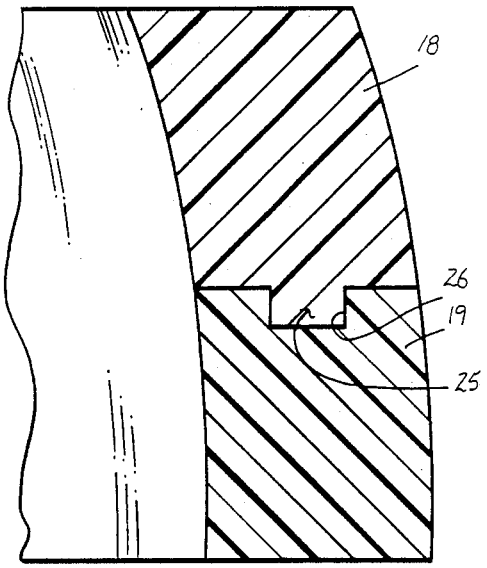
FIG. 5 is an orthographic view, taken along the lines 5—5 of FIG. 4, in the direction indicated by the arrows.

Reference to FIG. 5 notes that the top time band 18 utilizes an annular rib 25 directed downwardly and orthogonally relative to a bottom surface of the top time band 18 that is complementarialy and slidably received within an annular groove 26 mounted within the top surface of the bottom time band 19 to permit aligned rotation of the top and bottom time bands relative to one another. Further, the top and bottom time bands 18 and 19 may be formed of a transparent or translucent material in association with conventional illumination source such as a light bulb interiorly of the globe to enhance illumination and visibility of the time bands 18 and 19 and may be electrically associated with the electric power cord 20 for illumination thereof during operation of the apparatus.

Figure 6:
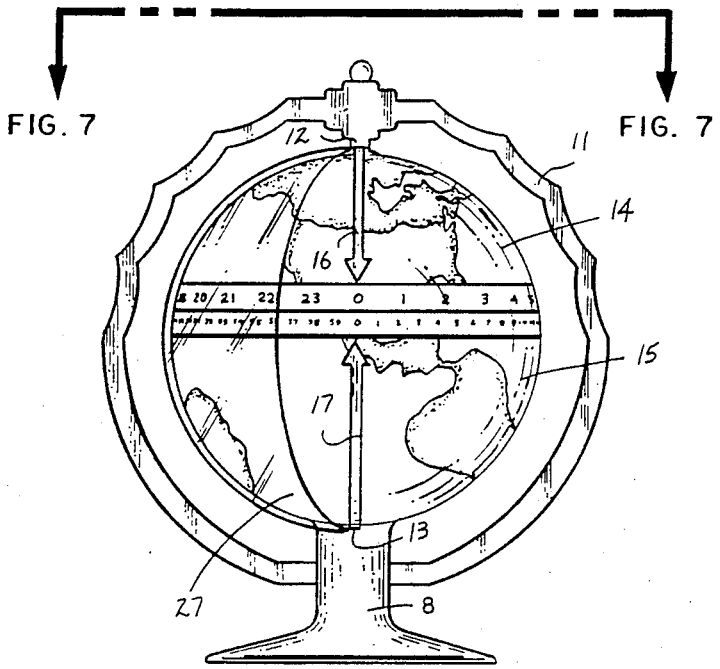
FIG. 6 is an orthographic view, taken in elevation, of the instant invention in association with a semi-spherical darkened shade structure.
Figure 7:
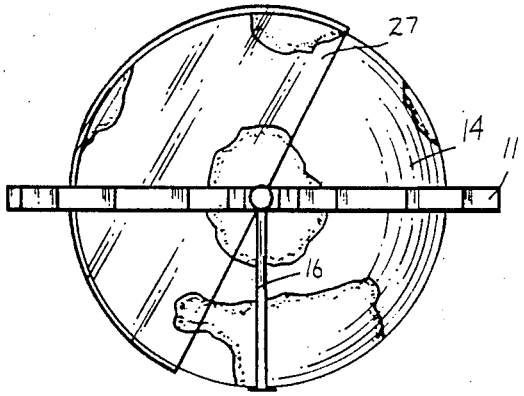
FIG. 7 is an orthographic view, taken along the lines 7—7 of FIG. 6, in the direction indicated by the arrows.

Reference to FIGS. 6 and 7 illustrates the use of a semi-spherical translucent darkened shade 27 that is pivotally mounted at its diametrically opposed upper and lower terminal ends to the respective top and bottom pivot axes 12 and 13. The shade 27 is pivotal relative to the top and bottom hemispheres 14 and 15 for simulation of the evening hours of a predetermined portion of the apparatus 10 in its simulation of the earth to provide enhanced understanding of that portion of the earth experiencing evening hours in a darkened state.

Figure 8:
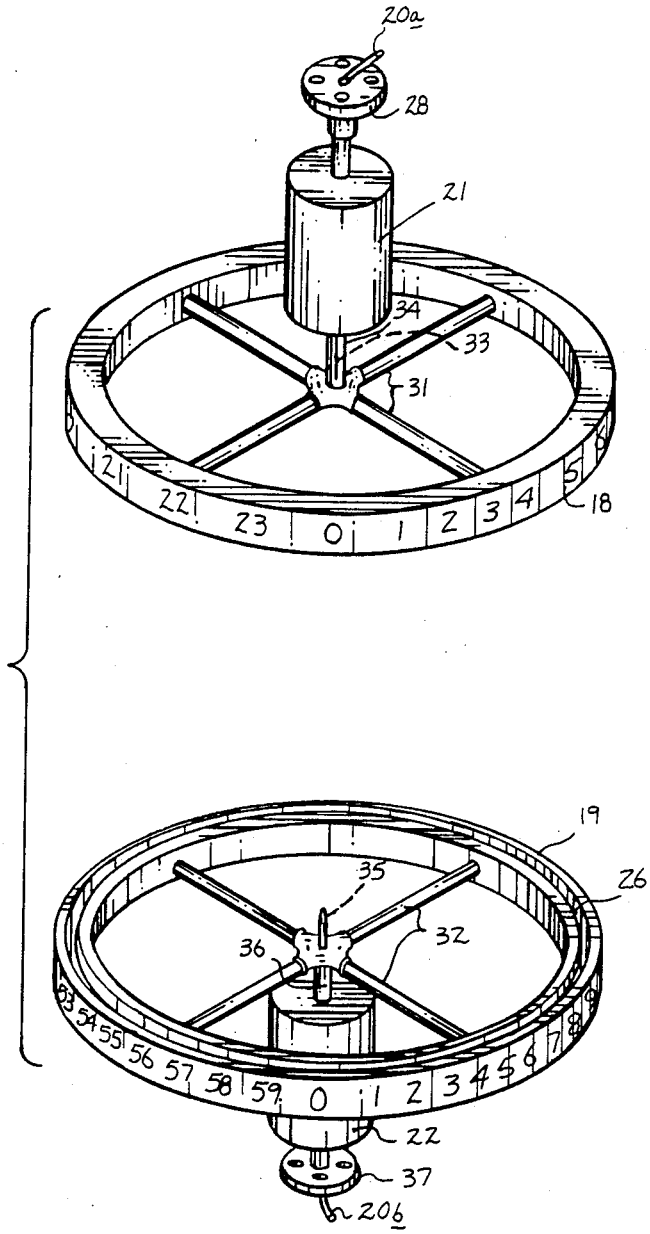
FIG. 8 is an isometric exploded illustration of the upper and lower equatorial bands utilized by the instant invention.

FIG. 8 further illustrates the assication of the top and bottom equatorial time bands 18 and 19. The top equatorial time band 18 includes upper spokes 31 mounted to an upper motor output hub 34. The upper motor output hub 34 further includes an axial recess 33 therewithin to receive an axial projection 35 mounted coaxially with the lower motor output hub 36. The lower motor output hub 36 utilizes equally spaced and diametrically aligned lower spokes 32 to secure the bottom time band 19 to the lower motor output 36, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all eqvivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A global clock apparatus comprising, in combination, a circular frame, the circular frame including a top pivot axis mounted to an uppermost portion of the circular frame, and a bottom pivot axis mouted to a lowermost portion of the circular frame, wherein the top and bottom pivot axes are coaxially aligned relative to one another, and a top hemisphere fixedly mounted to the top pivot axis, and a bottom hemisphere fixedly mounted to the bottom pivot axis, and a top indicator arrow pivotally mounted to the top pivot axis, and a bottom indicator arrow pivotally mounted to the bottom pivot axis, and a top annular time band rotatably mounted between the top and bottom hemisphere, and a bottom annular time band mounted between the top annular time band and the bottom hemisphere, wherein the top and bottom annular time bands are rotatable relative to one another.

2. An apparatus as set forth in claim 1 wherein the top annular the time band includes twenty-four divisions equally spaced relative to one another about the top annular time band, and the bottom annular time band including sixty further divisions mounted equally spaced relative to one another about the bottom annular time band.

3. An apparatus as set forth in claim 2 wherein the top annular time band includes an annular rib directed downwardly from a bottom surface of the top annular time band, and the bottom annular time band includes an annular groove formed within a top surface of the bottom annular time band, and the annular rib is complementarily and slidably received within the annular groove.

4. An apparatus as set forth in claim 3 wherein the top annular time band includes a top motor fixedly mounted to the top hemisphere, and including a top output shaft fixedly mounted to the top annular time band including a top timer to rotate in top annular time band at one revolution per twenty-four hours, and a bottom electric motor fixedly mounted to the bottom hemisphere, and wherein the bottom electrical motor includes a bottom timer to rotate the bottom electrical motor at one revolution per sixty minutes.

5. An apparatus as set forth in claim 4 further including a semi-spherical translucent darkened shade, the darkened shade pivotally mounted at its upper and lower terminal end positions to the top and bottom pivot axes respectively.

6. An apparatus as set forth in claim 5 wherein the top electric motor includes a recess coaxially formed within the top output shaft, and the bottom motor includes an axial projection receivable within the recess to align the top electric motor with the bottom electric motor.

* * * * *